United States Patent [19]

Heltemes

[11] Patent Number: 4,689,590

[45] Date of Patent: Aug. 25, 1987

[54] DEMAGNETIZATION APPARATUS FOR MAGNETIC MARKERS USED WITH ELECTROMAGNETIC ARTICLE SURVEILLANCE SYSTEMS

[75] Inventor: Eugene C. Heltemes, White Bear Lake, Minn.

[73] Assignee: Minnesota Mining and Manufacturing Company, St. Paul, Minn.

[21] Appl. No.: 887,721

[22] Filed: Jul. 21, 1986

[51] Int. Cl.[4] ..... H01F 13/00

[52] U.S. Cl. ..... 335/284; 361/151; 340/572

[58] Field of Search ..... 335/284; 361/149, 151, 361/267; 340/572; 324/259, 260, 261

[56] References Cited

U.S. PATENT DOCUMENTS

| | | | |
|---|---|---|---|
| 3,665,449 | 5/1972 | Elder et al. | 340/280 |
| 3,747,086 | 7/1973 | Peterson | 340/280 |
| 3,790,945 | 2/1974 | Fearon | 340/280 |
| 4,271,782 | 6/1981 | Bate et al. | 335/284 |
| 4,499,444 | 2/1985 | Heltemes et al. | 335/284 |

FOREIGN PATENT DOCUMENTS 2777884 5/1984 Australia .

OTHER PUBLICATIONS

Prodt. Info. brochure from 3M entitled "Plastiform-"-Permanent Magnet Mat. Prod. Nos. B-1060 (P1-1.6H), B-1030 (PL-1.4H), B-1013 (PL-1.4H).

*Primary Examiner*—George Harris

*Attorney, Agent, or Firm*—Donald M. Sell; James A. Smith; William B. Barte

[57] ABSTRACT

A demagnetization apparatus for use with magnetically based electronic article surveillance systems having a dual status anti-theft marker containing at least one demagnetizable control element which when demagnetized allows the marker to be detected by the system when the marker is present in an interrogation zone. The apparatus includes an elongated magnetic section contained within a housing which exhibits a succession of fields of alternate polarity and a portion of which exhibits generally decreasing intensities at the working surface of the housing along that portion of the section. The section and a cover plate are orientated such that the external fields near the working surface are sufficient in intensities to demagnetize the demagnetizable element of the marker positioned proximate thereto while being rapidly attenuated a short distance from the section. Accordingly, magnetically sensitive articles, such as for example, prerecorded magnetic cassettes, to which the markers are affixed, are not adversely affected.

20 Claims, 4 Drawing Figures

DEMAGNETIZATION APPARATUS FOR MAGNETIC MARKERS USED WITH ELECTROMAGNETIC ARTICLE SURVEILLANCE SYSTEMS

FIELD OF THE INVENTION

The present invention relates to electronic article surveillance (EAS) systems of the type in which a dual status marker, affixed to articles to be protected, causes a detectable signal in response to an alternating magnetic field produced in an interrogation zone. Such a dual status marker may preferably comprise a piece of a high permeability, low coercive force magnetic material and at least one permanently magnetizable control element. When the control element is demagnetized, a detectable signal corresponding to one state of the marker may be produced when the marker is in the zone, and when magnetized, a different signal corresponding to another state of the marker may be produced. More particularly, the present invention relates to an apparatus for changing the state of such markers.

BACKGROUND OF THE INVENTION

EAS systems of the type described above, are, for example, disclosed and claimed in U.S. Pat. No. 3,665,449 (Elder and Wright). With such systems, a dual status marker of the type described above may be sensitized, i.e., the high-coercive force control elements thereof demagnetized, by applying an alternating, diminishing amplitude magnetic field, or by gradually removing an alternating field of constant intensity such as by withdrawing a bulk magnetic eraser of the type supplied by Nortronics Company, Inc. of Minneapolis, Minn. As disclosed in the U.S. Pat. No. 3,665,449 patent, such a demagnetization operation may also be effected through the proper selection and arrangement of a series of permanent magnets in which adjacent magnets are oppositely polarized. By selecting the magnets to be of different strengths and by arranging them in an order ranging from highest to lowest (relative to the direction of travel), the magnetic field will appear to diminish in amplitude when passed over a control element. That patent also suggests that magnets of the same field strength may be arranged like inverted ascending steps or like an inclined plane so that the amplitude of the field is progressively diminished to produce the same result, and that it is not ordinarily necessary to demagnetize the control element in the strictest sense. Rather, the magnetic influence of the control element need only be reduced to an extent permitting magnetization reversal of the marker by the applied field.

While such techniques may be useful in many areas with the markers affixed to a wide variety of articles, the magnetic fields associated therewith have been found to unacceptably interfere with magnetic states associated with certain articles, such as prerecorded magnetic video and audio cassettes utilized in video rental businesses. Because of the compact size and popularity of such prerecorded magnetic cassettes, they are frequent targets for shoplifters, and hence likely articles with which anti-theft markers would be used. At the same time however, such affixed markers would be desirably sensitized upon return of the article, and it has been found that prior art demagnetization apparatus such as those described above may unacceptably affect signals prerecorded on the magnetic tapes within the cassettes.

SUMMARY OF THE INVENTION

In contrast to the demagnetization apparatus of the prior art acknowledged above in which the intensity of the magnetic fields produced thereby extend in a virtually uncontrolled fashion, the apparatus of the present invention provides a succession of fields of alternating polarity which rapidly decrease in intensity only a short, controlled distance from the surface of the apparatus and thus, while being capable of demagnetizing high-coercive force control elements of a marker brought close thereto, would be incapable of appreciably interfering with the magnetic signals recorded on tapes within a cassette to which the marker is affixed.

The apparatus of the present invention is thus adapted for use with an electronic article surveillance (EAS) system for detecting a sensitized dual status anti-theft marker secured to an article, the presence of which, within an interrogation zone is desirably known. The apparatus is particularly adapted for use with such a marker affixed to the outer surface of prerecorded video or audio cassettes. The marker in such a system includes a piece of low coercive force, high-permeability ferromagnetic material and at least one control element of a permanently magnetizable high coercive force material positioned proximate to the first material. Such an element, when demagnetized, results in the marker being in a first state, such as, for example, a sensitized state in which the marker may be detected when it is in the interrogation zone. Conversely, when the control element is magnetized, the marker is in a second state, such as, for example, a desensitized state in which the marker is not detected when it is in the zone.

The apparatus of the present invention comprises a housing having a working surface relative to which the article may be moved and an elongated section of a permanent magnetic material associated with the housing. The elongated section has a plurality of poles, and the poles exhibit at the working surface of the housing a succession of closely spaced fields of alternating polarity. A first portion of the elongated section exhibits at the working surface fields of generally decreasing intensities along that portion of the elongated section. Each pole extends across the width of the elongated section and the succession of poles extends along the length of the elongated section. In addition, the field intensity at the working surface associated with the most intense pole in the succession is approximately one and one-half times the predetermined value of coercive force of the control element. Thus, movement of the article relative to the working surface from a position adjacent the most intense field past each successively weaker field of opposite polarity will expose the marker affixed thereto to fields of alternate polarities and gradually decreasing intensities to substantially demagnetize the control element of the marker. The close spacing of the alternate poles results in a rapid decrease in intensity of the fields above the working surface so as not to adversely affect a magnetically sensitive object contained within the article.

BRIEF DESCRIPTION OF THE DRAWINGS

The present invention will be more fully described with reference to the accompanying drawings wherein like reference numerals identify corresponding components, and.

DESCRIPTION OF THE PREFERRED EMBODIMENT

Figure 1:
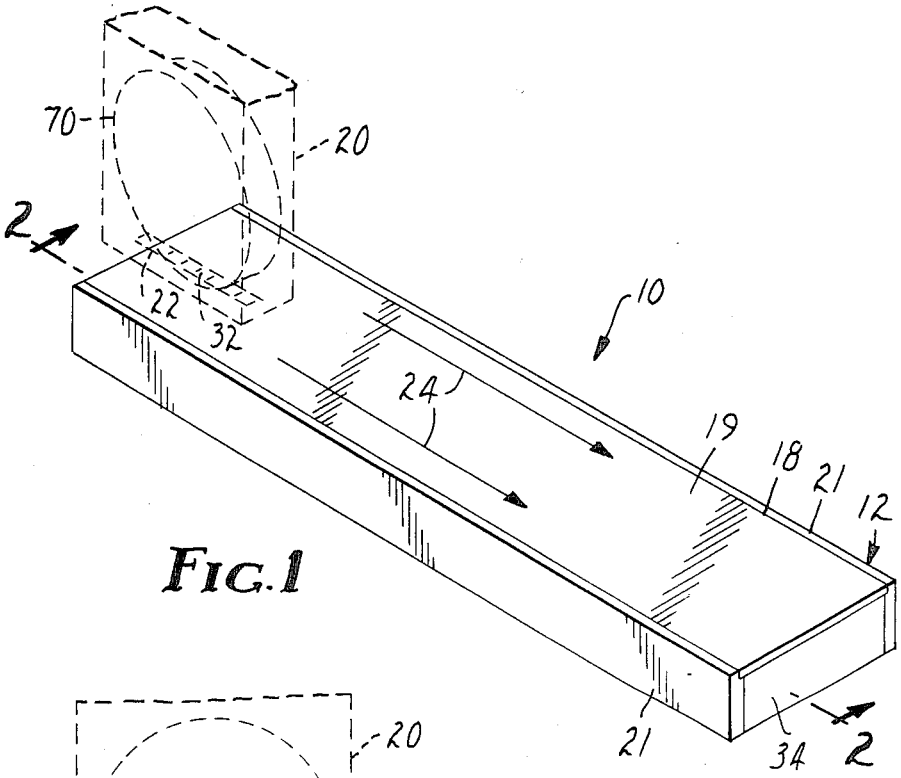
FIG. 1 is a perspective view of one embodiment of the demagnetization apparatus of the present invention.
Figure 2:
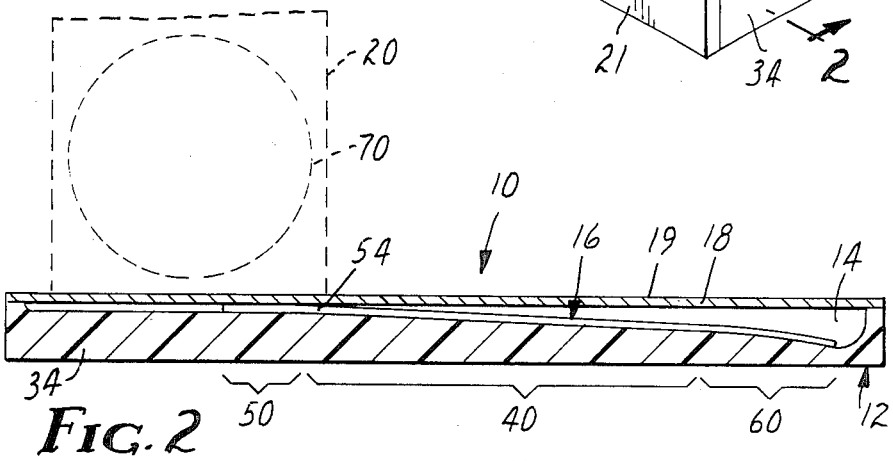
FIG. 2 is an enlarged cross sectional view of FIG. 1, taken along the lines 2—2.

As shown in FIGS. 1 and 2, the demagnetization apparatus of the present invention may be in the form of a counter top apparatus 10 having a housing 12, and contained within a cavity 14 therein an elongated magnetic section 16 as described hereinafter. The cavity 14 is in turn covered by a non-magnetic cover plate 18 which both covers and protects the elongated magnetic section 16. In addition, the cover plate 18 provides a working surface 19 over which an article 20 having a marker 22 affixed thereto may be passed during the use of the apparatus. For example, such a cover plate 18 may comprise a strip of non-magnetic stainless steel having a thickness in the range of 20 mils (0.50 mm). The use of a metallic cover plate 18 is further desired as such a surface resists wear from scratching or chipping as may otherwise occur with cover plates having a polymeric or painted surface, and it thereby remains aesthetically acceptable even over many cycles of use.

While the apparatus 10 may be used with the working surface 19 established by the cover plate 18 in a horizontal position, such that an article 20 may be moved across the horizontal surface, the apparatus may also be positioned to have the working surface 19 vertical.

The housing 12 of the apparatus 10, as shown in FIG. 1, includes two sides 21. The housing is preferably constructed of nonn-magnetic materials, and may be fabricated from appropriately dimensioned and finished hardwood, or may be formed from injection molded or machined plastic. Also, beveled faces (not shown) may be provided on the housing 12 to carry appropriate legends, manufacturer identification, instructions and the like.

In using the apparatus of FIG. 1, it will be recognized that the article 20 is to be moved in the direction shown by arrows 24, thus causing the marker 22 affixed to one surface of the article to be moved so that the marker 22 is passed over the elongated magnetic section 16 contained within the cavity 14. Thus, for example, if the article 20 is a typically packaged video cassette, the marker 22 could be affixed to one side of the cassette, and the cassette held so as to be positioned on the cover plate 18 and passed along the working surface 19 in the direction of arrows 24.

The marker 22 is typically constructed of a strip of a high permeability, low coercive force magnetic material such as a permalloy, certain amorphous alloys, or the like as disclosed, for example, in U.S. Pat. No. 3,790,945 (Fearon). The marker is further provided with at least one control element 32 of a high coercive force magnetizable material as disclosed, for example, in U.S. Pat. No. 3,747,086 (Peterson). The control element 32 is typically formed of a material such as vicalloy, magnetic stainless steel or the like, having a predetermined value of coercive force in the range of 50 to 240 oersteds. When such an element is magnetized, it prevents the marker from being detected by the system when the marker 22 is present in the interrogation zone.

The demagnetization of the control element 32 is effected upon exposure to the fields provided by the elongated magnetic section 16 when the element 32 is brought into close proximity with the magnetic fields associated with the section 16 at the working surface 19.

The details of the elongated magnetic section 16 are shown in the cross sectional view of FIG. 2. As may there be seen, the housing 12 of the apparatus 10 is shown to have a recess or cavity 14 within which the elongated magnetic section 16 may be positioned and supported by the housing within the recess, or by a frame 34 with the top of the recess enclosed by the cover plate 18. As an alternative, the section may be held in position within the recess 14 by the cover plate 18 (not shown).

Figure 3:
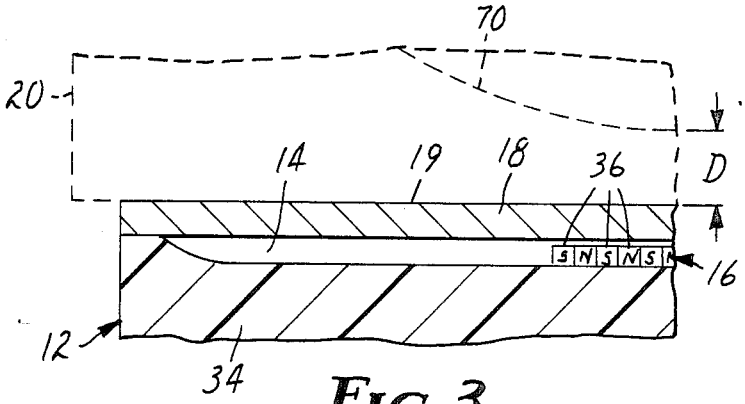
FIG. 3 is an enlarged fragmentary cross sectional view of the details of the elongated magnetic section of FIG. 2.

As shown in FIG. 2 and in greater detail in FIG. 3, the elongated magnetic section 16 has a plurality of poles 36 in a succession of closely spaced fields of alternate polarity and of generally equal intensity from one end of the elongated magnetic section 16 to the other. Each pole 36 extends across the width of the section 16, and the succession of poles extends along the length of the section 16. The elongated magnetic section 16 may be made of: (1) an injection molded permanent magnet material, such as type B-1060 "Plastiform" Brand sold by 3M Co., St Paul, Minn. which is subsequently magnetized after molding and arranged with alternating poles; or (2) a sheet material magnetized with uniform alternating poles, such as type B-1013 37 Plastiform" Brand sold by 3M Co., St. Paul, Minn. In the illustrated embodiment, the elongated magnetic section 16 was formed of a 0.090 inch thick and 3.0 inch wide sheet material of the type described above magnetized with six poles per inch.

The frame 34 is inclined with respect to the working surface 19 of the housing 12 so that a first portion 40 of the section 16 exhibits magnetic fields of generally decreasing intensity at the working surface of the housing. A second portion 50 is provided adjacent to the most intense field end of the first portion 40 and planar to the working surface 19 of the housing. The second portion 50 includes more than one pole which provide alternating fields of fairly constant intensities at the working surface 19 of the housing. The purpose of the second portion 50 is to assure at least one intense field in a direction opposite to the magnetization of the control element 32 in order to properly begin the demagnetization process. The second portion 50 also serves to eliminate any end effects associated with the first pole 54 of the first portion 40 having the most intense field associated therewith. In addition, the low field end of the elongated magnetic section 16 includes a third portion 60 curved for the purpose explained hereinafter.

Figure 4:
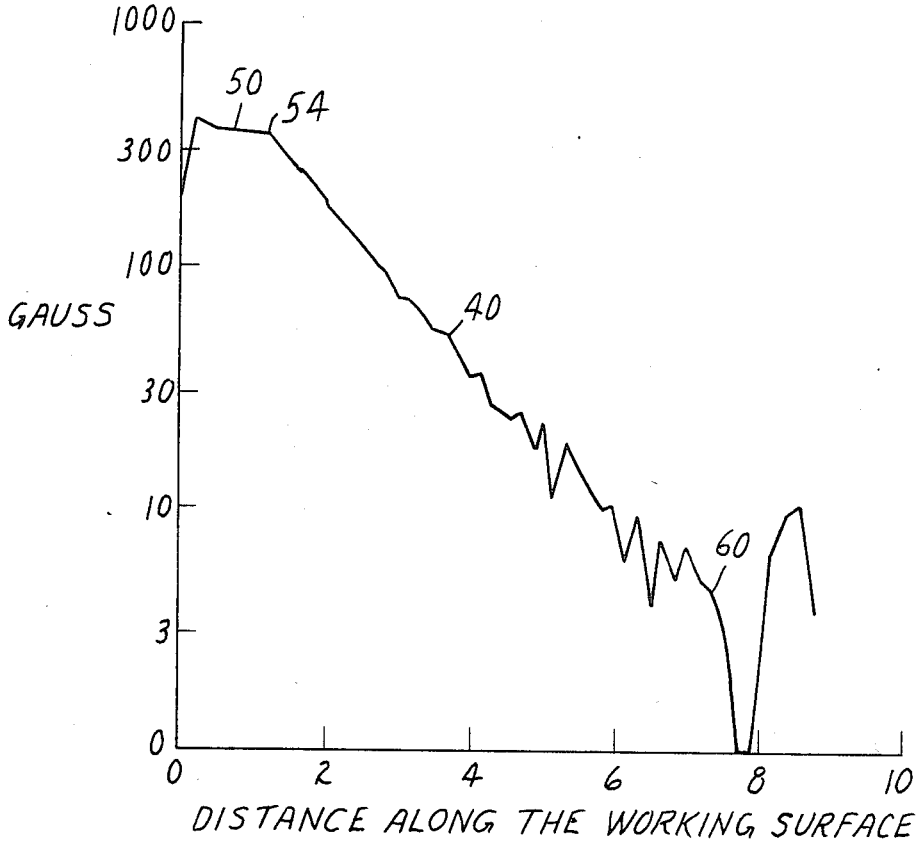
FIG. 4 is a graph illustrating field strength along the workding surface for a specific embodiment.

Thus, it has been found that by supporting the above magnetic section having six poles per inch on a frame 34 as illustrated in FIGS. 2 and 3 having a second portion 50 of 1.0 inch, a first portion 40 of 6.0 inches inclined at 2° 23"to the working surface 19 of the housing, and a third portion 60 of 2.0 inches having a radius of 12.2 inches, the poles will exhibit fields along the working surface as illustrated in FIG. 4.

It is believed that the increase in field intensity at the end of the third portion 60 as shown in FIG. 4, is the result of the fact that the field at the working surface 19 above the last pole is not subjected to a compensating field from an adjacent pole of opposite polarity. It is essential that this increased field be sufficiently small so as not to allow partial remagnetization of the control element 32. Thus, it has been found that the third portion 60 having an arcuate curve away from the working surface provides a more rapid increase in the distance from the working surface so that a sufficiently low field will be exhibited at the working surface above the last pole to minimize any affect on the control element 32. It should be appreciated that the third portion may alternatively be inclined at a steeper angle of incline than the first portion 40. However, by utilizing an arcuate curve a smoother transition is provided between the first portion 40 and the third portion 60.

As illustrated in FIG. 4, the decrease in intensity is non-uniform. This is believed to be the result of small variations in size and magnetization of different poles. However, such minor irregularities can be tolerated so long as the variations are not large enough to prevent demagnetization of the control element 32. If the fields were to decrease too slowly, the elongated section 16 would need to be impractically long, and if the fields were to decrease too rapidly, the demagnetization would not be complete, especially in view of the non-uniformities as mentioned above. Thus, demagnetization will occur if on the average the field intensity at the working surface 19 associated with each successive pole decreases by 5 to 20 percent between any two adjacent poles.

It is critical that the field associated with the most intense pole be strong enough to start the demagnetization process. This has been found to equal approximately one and one-half times the predetermined value of coercive force of the control elements. However, it is also critical that the field intensity not be strong enough to adversely affect a magnetically sensitive object 70 contained within the article 20 during demagnetization of the control elements. Pre-recorded audio cassettes are adversely affected by magnetic fields greater than about 100 oersteds while pre-recorded video cassettes can withstand higher fields, perhaps as much as 200 oersteds. It is necessary that the fields of the demagnetization apparatus decrease rapidly away from the working surface 19 so as to be sufficiently small at a distance D measured from the working surface 19 to the magnetically sensitive object 70. A typical distance D is within the range of 1/16 to $\frac{1}{8}$ of an inch. This is accomplished by keeping the pole spacing small enough so that away from the surface, different poles contribute to the effective field, resulting in partial cancellation from adjacent poles of opposite polarity. At the same time, the pole spacing must not be too small or the fields at the surface will not be intense enough to start the demagnetization process. Thus, to demagnetize the control element 32 of the affixed marker 22 without adversely affecting a pre-recorded cassette, a field intensity of no more than 450 oersteds, preferably in the range of 350-420 oersteds at approximately 0.030 inch above the working surface with a pole spacing of 6 or 7 poles per inch is preferred.

I claim:

1. An apparatus which in movement relative to an article, having affixed thereto a dual status anti-theft marker including at least one remanently magnetizable control element having a coercive force of a predetermined value, demagnetizes said control element to change the status of the marker, said apparatus comprising:

a housing having a working surface relative to which an article may be moved, and an elongated section of a permanent magnetic material associated with said housing;

said elongated section having a plurality of closely spaced poles, said poles exhibiting at the working surface a succession of fields of alternating polarity and a first portion of which exhibits at the working surface fields of generally decreasing intensities along at least that portion of said elongated section;

each pole extending across the width of said elongated section and the succession of poles extending along the length of said elongated section; and wherein the field intensity at said working surface associated with the most intense pole in said succession is approximately one and one-half times said predetermined value of the coercive force of the control element, whereby movement of said article relative to the working surface of said housing from a position adjacent the field associated with the most intense field past each generally successively weaker field of opposite polarity, will expose the marker affixed to the article to fields of alternate polarities and generally decreasing intensities, thereby substantially demagnetizing the control element of said marker, and the close spacing of the alternate poles results in a rapid decrease in the intensities of the fields above the working surface so as not to adversely affect a magnetically sensitive object contained within the article.

2. The apparatus defined in claim 1, wherein the pole to pole spacing along the length of the elongated section is no more than 0.25 inch.

3. The apparatus defined in claim 1, wherein said first portion is inclined at a predetermined angle relative to said working surface of said housing to exhibit said succession of fields of alternate polarity and of decreasing intensities at said working surface.

4. The apparatus defined in claim 3, wherein said elongated section further comprises a second portion associated with that end of said first portion which exhibits the most intense field at the working surface of said housing, said second portion includes more than one pole, said poles exhibit at the surface of said housing a succession of closely spaced poles of alternating polarity and of approximately uniform intensities, and the maximum intensity of the fields at said working surface associated with said second portion is approximately one and one-half times the predetermined value of coercive force of said control element.

5. The apparatus defined in claim 3, wherein said elongated section further comprises a third portion associated with that end of said first portion which exhibits the least intense field at the working surface of said housing, and said third portion includes a plurality of closely spaced poles, said poles exhibit at said working surface a succession of fields of alternating polarity and of generally decreasing intensities at a greater rate along said third portion than along said first portion.

6. The apparatus defined in claim 1, further comprising a thin non-magnetic plate covering the working surface of said housing to protect said elongated section while providing a durable wear surface allowing the magnetic lines of flux to extend therethrough substantially unattenuated.

7. The apparatus defined in claim 6, wherein said housing further comprises a recess opening onto the working surface of said housing within which said elongated section is positioned.

8. The apparatus defined in claim 1, wherein said elongated section comprises a plurality of permanent magnets.

9. The apparatus defined in claim 8 wherein said permanent magnets are injection molded.

10. The apparatus defined in claim 1, wherein said elongated section includes a permanent magnet material which has been magnetized with approximately uniform alternating poles.

11. The apparatus defined in claim 1, wherein said poles of alternate polarity are adjacent one another.

12. The apparatus defined in claim 1, wherein said poles are within the range of 8 poles per inch to 4 poles per inch.

13. The apparatus defined in claim 1, wherein the average field intensity at the working surface of said housing associated with each pole of said first portion intermediate said most intense pole and said least intense pole decreases in the range of 5 to 20 percent between any two adjacent fields.

14. The apparatus defined in claim 1, wherein the field above said most intense pole is within the range of 350 to 420 oersteds.

15. An apparatus capable of substantially demagnetizing at least one control element of a dual status marker affixable to an article containing a magnetically sensitive tape, said apparatus comprising:

a housing having a working surface relative to which the article may be moved;

an elongated section of a permanent magnetic material associated with the working surface of said housing having a plurality of closely spaced poles from one end of said elongated section to the other;

said poles exhibiting at the working surface a succession of magnetic fields of alternating polarity and at least a first portion exhibiting a plurality of magnetic fields of generally decreasing intensities at said working surface along that portion of said elongated section; and the most intense field at approximately 0.030 inch above said working surface being no more than 450 oersteds such that when said article is moved relative to the working surface of said housing from a position adjacent the most intense field at the working surface past each generally successively weaker field of opposite polarity, exposing the marker affixed to the article to said fields of alternate polarities and generally decreasing intensities, thereby substantially demagnetizing the control element associated with said marker, and whereby the close spacing of the alternate poles results in a rapid decrease of the intensity of the fields away from the working surface so as not to affect the magnetically sensitive tape contained within the article.

16. The apparatus defined in claim 15, wherein said first portion is inclined at a predetermined angle relative to said working surface to exhibit said succession of fields of generally decreasing intensities at said working surface.

17. The apparatus defined in claim 15, wherein a second portion of said elongated section associated with one end of said elongated section approximate to said most intense field of said first portion exhibits at the working surface more than one field of substantially uniform intensity and of approximately equal intensity to said most intense field.

18. The apparatus defined in claim 17, wherein a third portion of said elongated section associated with the other end of said elongated section approximate to said least intense field of said first portion exhibits at the working surface a plurality of magnetic fields of generally decreasing intensity at a greater rate than said first portion of said elongated section.

19. The apparatus defined in claim 15, wherein each pole extends across the width of said elongated section and the succession of poles extends along the length of said elongated section.

20. The apparatus defined in claim 15, further comprising a thin non-magnetic plate covering the working surface of said housing to protect said elongated section and to provide a durable wear surface allowing the magnetic lines of flux to extend therethrough substantially unattenuated.

* * * * *